United States Patent [19]

Kitchen

[11] Patent Number: 4,621,609

[45] Date of Patent: Nov. 11, 1986

[54] HEATER AND BURNER ASSEMBLY THEREFOR

[76] Inventor: John A. Kitchen, R.R. #3, Hastings, Ontario, Canada, K0L 1Y0

[21] Appl. No.: 644,287

[22] Filed: Aug. 27, 1984

[51] Int. Cl.[4] ..... F24C 1/00; F23D 11/00

[52] U.S. Cl. ..... 126/56; 126/97; 126/45; 431/206; 431/326

[58] Field of Search ..... 431/326, 206; 126/56, 126/57, 96, 59, 1 R, 1 D, 1 AE, 15 R, 1 AD, 17, 19 R, 19 M, 28, 37 R, 39 C, 48, 45, 49, 307 R, 312, 97, 77; 236/30, 31, 32

[56] References Cited

U.S. PATENT DOCUMENTS

| | | | |
|---|---|---|---|
| 5,418 | 5/1893 | Thorpe | 126/215 |
| 119,249 | 9/1871 | Thompson | 126/96 |
| 212,003 | 2/1879 | Hughes | 126/215 |
| 228,762 | 7/1880 | Irwin | 126/15 |
| 281,515 | 7/1883 | Johnstone | 126/15 |
| 431,295 | 7/1890 | Otto | 126/45 |
| 481,511 | 8/1892 | Randall | 126/97 |
| 510,236 | 12/1893 | Boeck | 126/97 |
| 601,128 | 3/1898 | Dally | 431/206 |
| 814,241 | 3/1906 | Smith | 431/206 |
| 978,990 | 12/1910 | Damon | 126/96 |
| 1,024,362 | 4/1912 | Rice | 431/206 |
| 1,493,020 | 5/1924 | Chapman | 126/96 |
| 2,101,409 | 12/1937 | Nier | 431/206 |
| 2,663,391 | 12/1953 | Kuhns | 126/25 R |
| 2,754,815 | 7/1956 | Imber | 126/96 |
| 2,771,763 | 11/1956 | Kracauer | 431/206 |
| 3,552,377 | 1/1971 | Hodges | 126/307 R |

FOREIGN PATENT DOCUMENTS

| | | | |
|---|---|---|---|
| 1120395 | 12/1961 | Fed. Rep. of Germany | 126/96 |

*Primary Examiner*—William E. Lyddane
*Assistant Examiner*—Gerald A. Anderson
*Attorney, Agent, or Firm*—Rogers, Bereskin & Parr

[57] ABSTRACT

A heater, particularly for emergency use in a car or other vehicles is designed to use solid paraffin wax fuel. The heater has a housing containing a combustion chamber and burner. A vent duct is angled outwardly from the housing and both provides combustion air and permits exhaust of combustion products. The vent duct can be inserted through a window opening in a vehicle so that interior air is not consumed or contaminated when the heater is in operation.

14 Claims, 3 Drawing Figures

HEATER AND BURNER ASSEMBLY THEREFOR

BACKGROUND OF THE INVENTION

FIELD OF THE INVENTION

This invention relates generally to heaters of the type having liquid fuel burners. The term "liquid fuel" includes fuels which are solid at room temperature and which must be liquified in order to burn.

The invention has been devised in the environment of heaters for temporary or emergency use, for example in a stranded car, boat or other vehicle or in an emergency shelter. A heater of this type should meet a number of criteria. The heater should be designed so that it can be stored for long periods of time and under varying climatic conditions without deteriorating. At the same time, it should be capable of being quickly and easily brought into operation without the need for external power and should be capable of producing a reasonable amount of heat for an extended period of time. Other considerations are safety in storage and use, ease of portability, and avoidance of contamination of the atmosphere within the vehicle or shelter. Where the heater is of the type in which fuel is burnt to produce heat, the burner should be designed to operate free of smoke and soot.

An object of one aspect of the invention is to provide an improved heater which addresses at least some of these problems.

BRIEF SUMMARY OF THE INVENTION

One aspect of the invention provides a heater which includes a housing defining a combustion chamber having an exhaust outlet. The housing is adapted to permit radiation of heat produced by combustion in the chamber. A burner is disposed in the combustion chamber and includes a wick communicating with the a fuel supply for delivering fuel to a combustion zone, in use. Combustion air is brought to the burner through a passageway in the housing. The heater also includes a vent duct defining a first passageway which provides communication between the air inlet passageway in the housing and a remote air inlet at an outer end of the duct. The duct also defines a second passageway providing communication between the combustion chamber exhaust outlet and an exhaust opening adjacent the air inlet. The duct is of elongate form and extends outwardly from the housing to space the air inlet and exhaust outlet from the housing so as to permit the heater to be operated with the housing within a space to be heated, while being vented outside the space through said vent duct.

While the broad aspect of the invention is not limted to any particular fuel, paraffin wax fuel offers a number of significant practical advantages in a heater intended for emergency use. The wax is a solid at room temperature which means that the heater can be stored filled with fuel, with no risk of spillage. At the same time, the wax can be melted very readily which means that, with suitable design of the burner (see below) the heater can be ready for virtually instant use. Also, paraffin wax does not deteriorate in storage and is readily available in blocks of a convenient size and shape. Broadly considered candles could be used to provide the burner and fuel supply. Preferably, however, the fuel is supplied from a reservoir. In one embodiment, the reservoir be designed to receive blocks of paraffin wax and to allow additional wax blocks to be conveniently added to the reservoir even when the heater is in operation.

The vent duct allows the heater to take in combustion air and exhaust waste combustion products outside the space being heated. For example, where the heater is used in a car, the heater can be arranged with the duct projecting through an open window and the window can then be closed onto the duct and any remaining space sealed, as will be described later.

The burner of the heater comprises a fuel reservoir, a combustion air inlet tube disposed in a generally upright position above the reservoir and having an air outlet at its upper end and an air inlet at its lower end. A wick is provided in the form of a mass of non-combustible fibres wrapped around an annular support surrounding the air outlet and defining a combustion zone. Means is provided constraining the fibres to extend downwardly from the support and into the fuel reservoir for conveying liquid fuel to the combustion zone by capilliary action.

Where the fuel is normally solid at room temperature, the burner will be provided with suitable means for conducting heat from the burner into the reservoir to melt the wax when the burner is first ignited, and keep the wax liquid during operation of the burner.

BRIEF DESCRIPTION OF THE DRAWINGS

The following drawings illustrate a preferred embodiment of the invention and will now be described. In the drawings.

DESCRIPTION OF THE PREFERRED EMBODIMENTS

Figure 1:
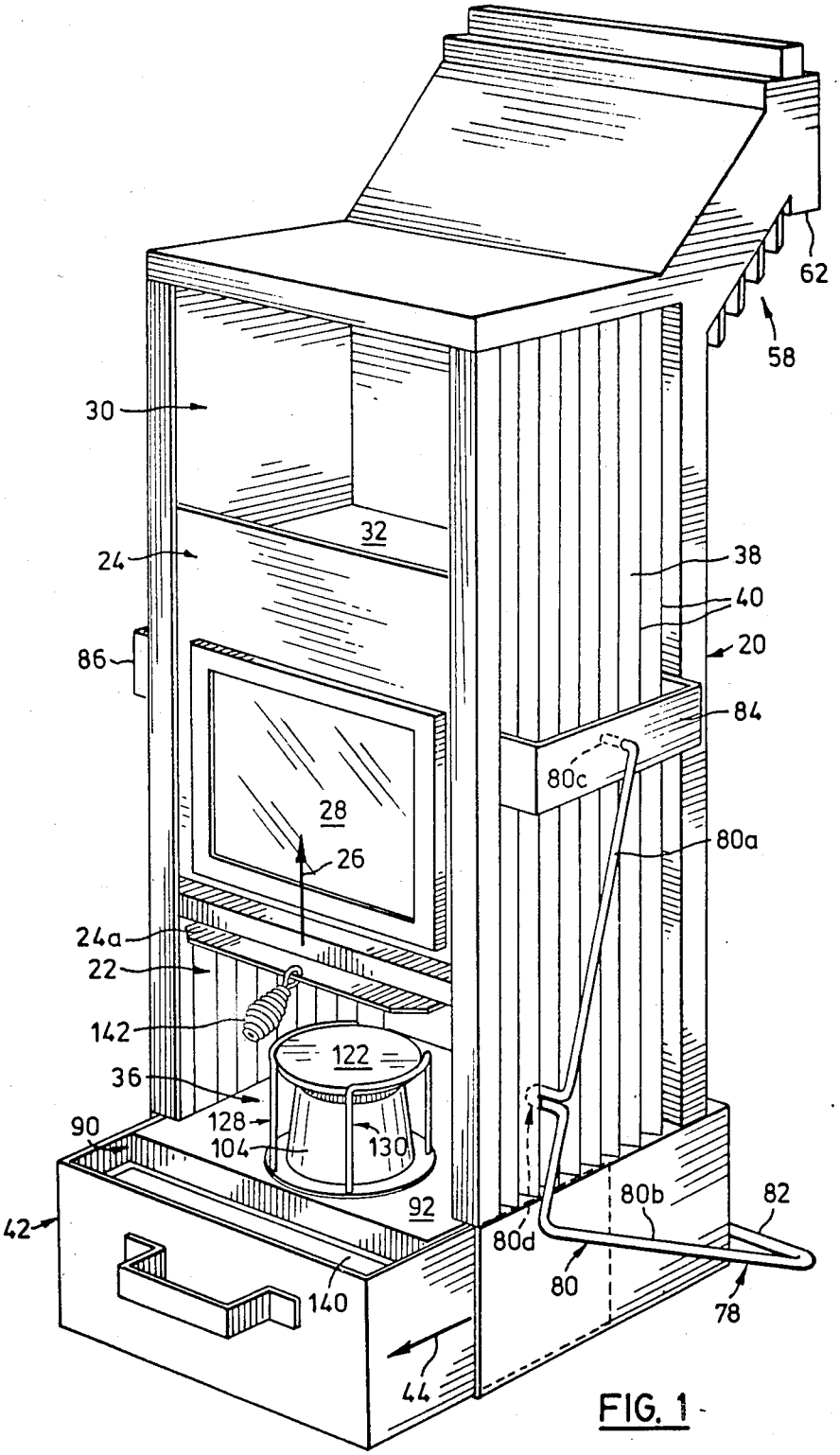
FIG. 1 is a perspective view from the front of a heater in accordance with the invention, with the burner and fuel reservoir shown partly removed from the housing of the heater.
Figure 2:
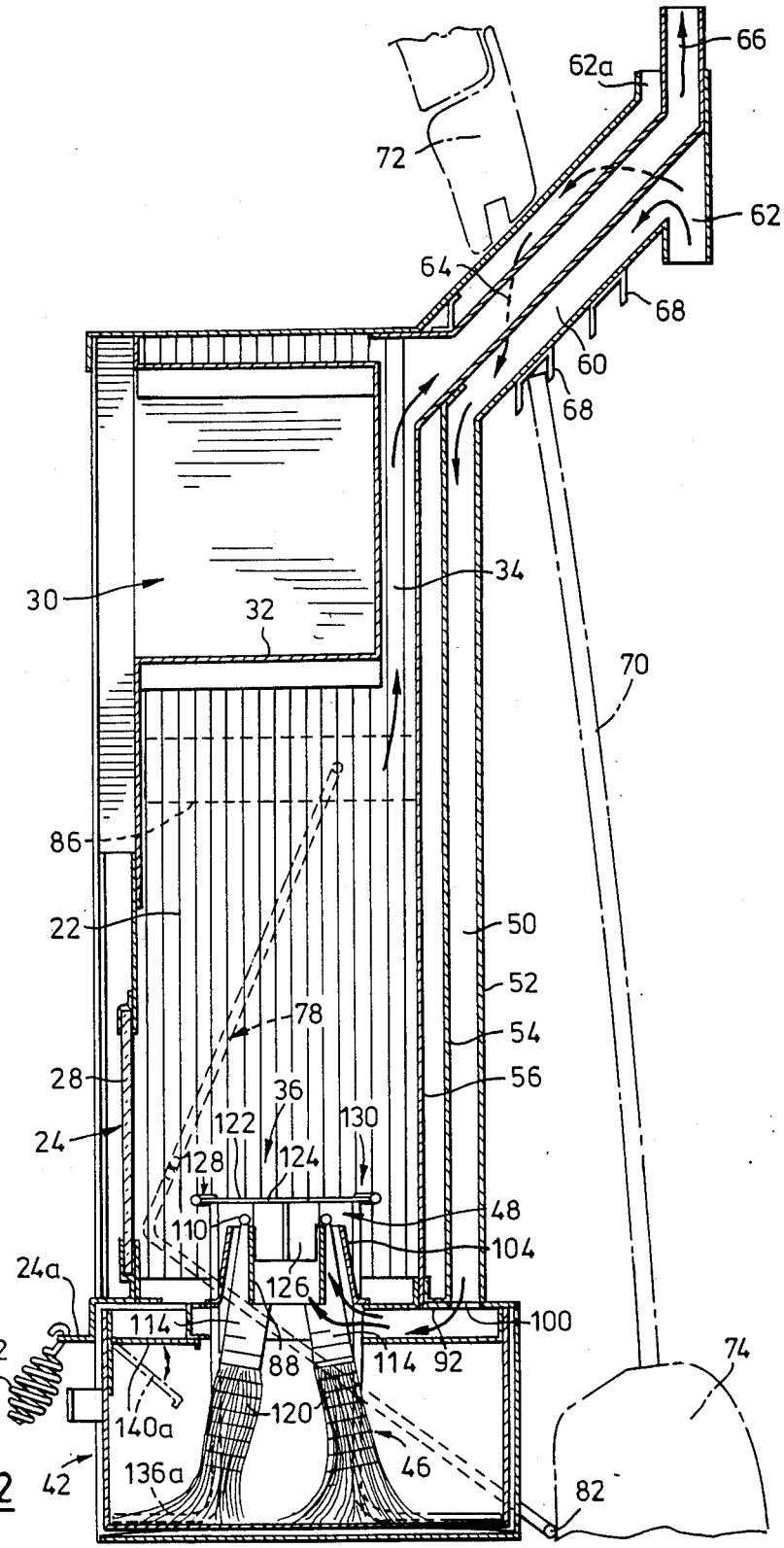
FIG. 2 is a vertical sectional view corresponding to FIG. 1.

Referring first to FIGS. 1 and 2, the heater is shown to comprise a housing 20 which defines a combustion chamber 22 internally thereof. Chamber 22 is shown in vertical section in FIG. 2 and in FIG. 1 part of the combustion chamber 22 is visible below a door 24 at the front of the casing. Door 24 can be raised and lowered as indicated by arrow 26 and incorporates a window 28 permitting combustion to be visually supervised from the front of the heater. An opening 30 provided in housing 20 above the combustion chamber provides a shelf 32 on which drinks or foods can be kept warm or warmed when the heater is in operation. Referring back to FIG. 2, it will be seen that combustion chamber 22 has an outlet 34 which in this case is defined by a passageway at the back of opening 30. Passageway 34 extends the full width of housing 20 and rises vertically behind opening 30 so that the back wall of the opening is in effect heated by combustion gases from the combustion chamber. Within the combustion chamber is a burner generally denoted 36 which, of course, provides the main source of heat for the heater itself but also at the same time heats shelf 32 from below.

In the illustrated embodiment, housing 20 and door 24 (except for the window 28) are constructed of steel and the housing generally radiates heat produced by combustion in chamber 22. Housing 20 includes side walls, one of which is visible at 38 in FIG. 1 and both of which are provided with vertical ribs 40 which assist heat radiation.

Also disposed within housing 20 is a fuel reservoir 42 which in this case also serves as a support for the burner 36. Reservoir 42 is designed as a generally rectangular tray or drawer which can be withdrawn from housing 20, together with burner 36, as indicated by arrow 44 in FIG. 1.

Figure 3:
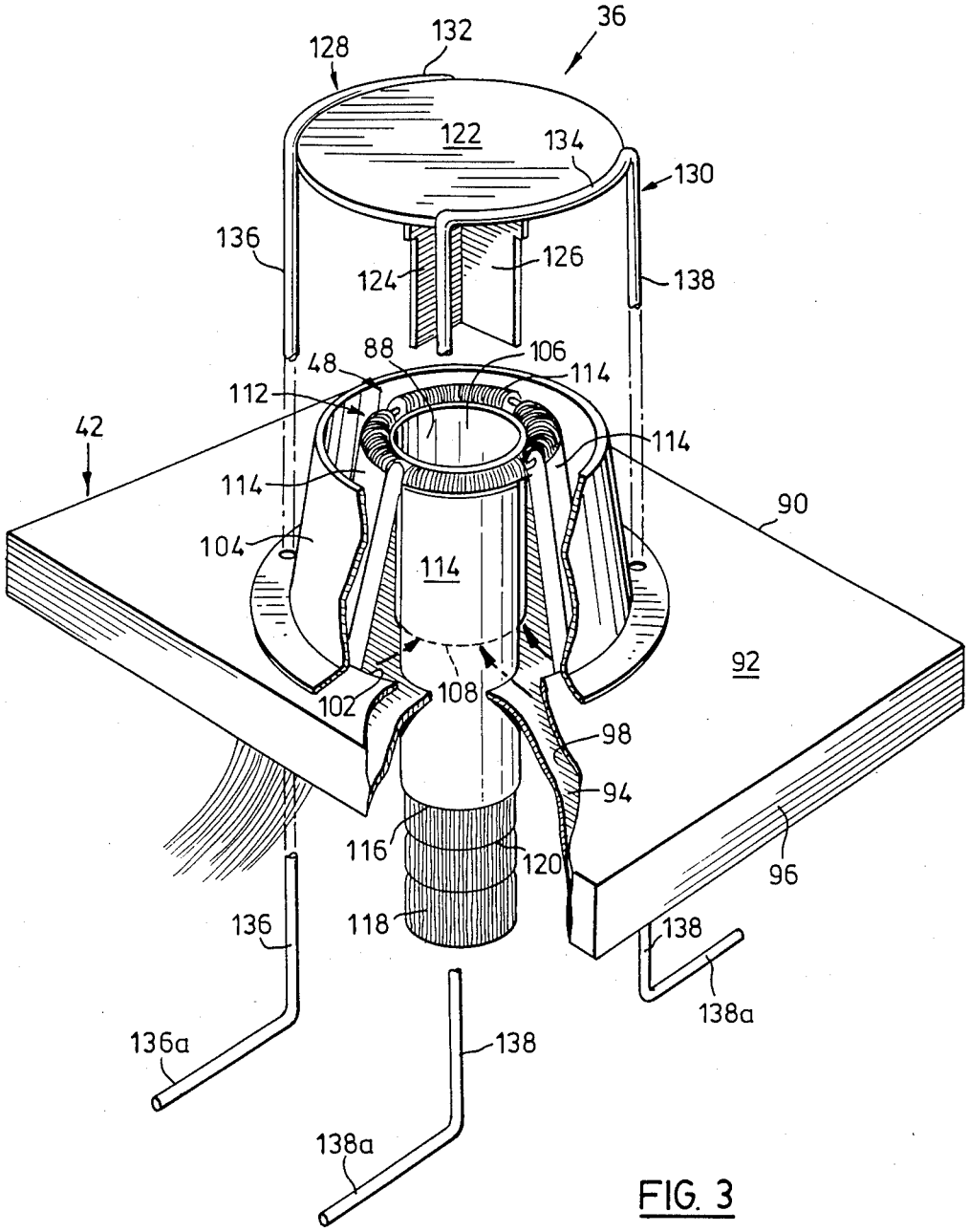
FIG. 3 is a perspective view, partly exploded and partly broken away, showing the burner of the heater shown in FIGS. 1 and 2.

Referring to FIG. 2, burner 36 includes a wick generally indicated at 46 which communicates with the fuel reservoir for delivering fuel to the combustion zone of the burner, which is generally indicated at 48 in FIGS. 2 and 3. Details of the burner construction will be given later primarily with reference to FIG. 3. For present purposes, it is sufficient to note that the wick will convey fuel from reservoir 42 to the combustion zone 48 when the burner 36 is in operation. The heater shown in the drawings has been designed to operate using solid paraffin wax fuel which is melted by the heat of combustion when the heater is in operation, as will be described later.

Combustion air for burner 30 is conveyed to the burner through an air inlet passageway 50 in housing 20. Again, passageway 50 extends across the entire width of housing 20. The passageway is formed between the rear wall 52 of housing 20 and an intermediate wall 54 spaced from a back wall 56 of the combustion chamber. In this way, an air space is created between the combustion chamber and the air passageway 50. The air space (and the passageway 50) help to prevent the back wall 52 of the heater becoming excessively hot when the heater is in operation, as a safety feature.

The heater also includes a vent duct generally denoted 58 through which combustion air can be drawn into the heater and combustion products vented to the outside.

As best seen in FIG. 2, duct 58 defines a first passageway 60 providing communication between the air inlet passageway 50 within housing 20 and a remote air inlet 62 at the outer end of duct 58. The duct also includes a second passageway 64 which provides communication between the combustion chamber outlet 34 and an exhaust opening 66 adjacent air inlet 62. As can best been seen from FIG. 1, duct 58 extends over the whole width of housing 20 and the passageways 60 and 64 are generally of rectangular shape in cross-section.

Referring back to FIG. 2, it will be seen that the inlet opening 62 and exhaust opening 66 are formed by portions of the respective passageways 60 and 64 which are directed generally vertically considering the heater oriented in its normal position of use on a horizontal surface. In addition, the passageways 60 and 64 are designed so that the exhaust gas passageway 64 is disposed generally centrally of passageway 60. Thus, in FIG. 2, portions of passageway 60 are shown both above and below passageway 64. In FIG. 1, the exhaust outlet 66 appears as somewhat narrower than the overall width of duct 58, which illustrates the fact that the air inlet passageway also extends around the ends of passageway 64 (at the sides of housing 20). Passageway 60 also has an air inlet **62*a* which is directed vertically upwardly adjacent the exhaust outlet 66, and oppositely to air inlet 62. This means that the air supply to the heater is virtually immune to the effects of winds and drafts. For example, a positive wind pressure at inlet 62*a* will be compensated for by an equal and opposite negative pressure at inlet 62**.

The fact that the air inlet passageway 60 surrounds the exhaust passageway 64 means that the external surfaces of vent 58 will be kept relatively cool by the outside air circulating around the exhaust passageway, thereby avoiding overheating of the external surfaces of duct 58. The bottom wall of the duct is also provided with channels 68 which not only act as fins for dissipating any heat build-up but also serve as locating points for positioning the heater with the vent 58 in an opening between the space to be heated and the outside with the back wall 52 of the housing 20 clear of adjacent surfaces.

By way of example, FIG. 2 shows a typical example of a position in which the heater might be installed in, say, a car or truck. Reference numeral 70 indicates the window of the car of truck while numerals 72 and 74 show parts of the window frame above and below the window opening. Window 70 is shown positioned in one of the channels 68 on duct 58. Sections of foam rubber (not shown) are used to fill and close off portions of the opening which are not occupied by duct 58.

It will also be seen that the duct 58 is angled upwardly away from housing 20. This has been found to be a particularly convenient duct orientation for a heater which is designed to be used in cars and trucks. The arrangement not only ensures convenient positioning of the heater within the vehicle but also that exhaust gases are discharged at a position above the opening through which the duct extends. A duct inclination of approximately 45° with respect to the horizontal (considering the heater oriented as shown in FIG. 2) is believed to be preferred in terms of adaptability and versatility of installation of the heater, combined with good draft in operation.

The housing of the heater is held clear of contact with the inside surface of the door of the vehicle by a handle which is shown in dotted outline at 78 in FIG. 2 and in full lines in FIG. 1. The handle includes two angled side limbs which are pivotally coupled to the sides of housing 20 and are connected at their outer ends by a cross member. One of those side limbs is shown at 80 in FIG. 1 and part of the cross member is visible at 82. The side limb at the opposite side of the housing is similar to limb 80 and it will be seen that the limb comprises two portions **80*a* and 80*b* which are disposed generally at right angles to one another. Limb 80*a* has an in-turned outer end portion 80*c* which is received in a bracket 84 welded to the side of housing 20. The limb which is not visible in FIG. 1 is similarly pivoted to a bracket 86 at the other side of the housing coaxially with the pivot axis for limb 80*a***.

Limb **80*a* (and the corresponding limb at the opposite side of the housing) includes an inwardly deflected portion 80*d* which is shaped to fit between adjacent ones of the fins 40 at the side of housing 20 to appropriately position the cross member 82 with respect to the housing. The cross member then rests against the inside surface of the door of the vehicle as shown in FIG. 2 and maintains the housing at the appropriate orientation. Handle 78 is designed to permit its side limbs to be splayed to an extent sufficient to permit the inwardly deflected portions of the side limbs to be engaged in different positions between the fins 40 so that the orientation of the housing can be varied. The side limbs can also be completely disengaged from between the fins 40 and the handle pivoted round to bring the cross member 82 into an overhead position for carrying the heater. As best seen in FIG. 2, the handle is dimensioned so that it can be swung forwardly below the fuel reservoir 20 to bring cross member 82** into this position.

Referring now to FIG. 3, it will be seen that burner 36 includes a combustion air inlet tube 88 which is disposed in a generally upright position above the fuel reservoir 42. For clarity of illustration, the whole of reservoir 42 has not been shown in FIG. 3 but reference numeral 90 generally denotes the top cover of the reservoir, which comprises upper and lower plates 92 and 94 respectively and a side wall 96 joining the plates so as to define an air supply duct 98 therebetween. As best seen in FIG. 2, plate 92 has an opening 100 which mates with the lower end of the air inlet passageway 50 in housing 20 when the fuel reservoir is fully seated within the housing. This allows combustion air entering the heater from duct 58 to flow into the air supply duct 98 shown in FIG. 3. Plate 92 is then provided with an opening 102 which is surrounded by a shroud 104 of generally truncated conical shape disposed generally concentrically with respect to tube 88. Tube 88 is open at both ends, the ends defining an air outlet 106 at the upper end of tube 88 and an air inlet 108 at its lower end. Thus, primary combustion air entering the air supply duct 98 in use can flow up through tube 88 to the combustion zone 48.

The heater also includes a wick in the form of a mass of non-combustible filaments or fibres wrapped around an annular support surrounding the air outlet 106 at the combustion zone 48. In this embodiment, the annular support member is a copper ring of a diameter slightly larger than the diameter of tube 88. The ring is shown in section at 110 in FIG. 2. As seen in FIG. 3, the filaments from which the wick is formed are wrapped around the ring so that the ring is concealed by a generally annular mass of wrapped filaments generally indicated at 112. The filaments are constrained to extend downwardly from support 110 and into the fuel reservoir for conveying liquid fuel to the combustion zone 48 in use. In the particular embodiment illustrated, constraint of the filaments is achieved by housing them within four flattened tubes 114 which extend downwardly from a position just below the ring 114 and through the lower plate 94 forming the top of the reservoir. As shown in FIG. 3, the plates 92 and 94 have been broken away so that the full extent of one the tubes 114 can be seen. The lower edge of that tube is indicated at 116. The filaments extend down below that edge as generally indicated at 118 and are constrained by metal rings 120 which may be formed by part of a coil spring. The tubes 114 meet at their upper ends where they are tack-welded together and to tube 88. The tubes 114 are also tack-welded to plate 94.

The filaments from which the wick is formed may be of various types but are preferably glass or asbestos fibres. In the particular embodiment illustrated, relatively long glass fibres were used. Within each tube 114 is a bundle of relatively long fibres which are wrapped in a generally U-shaped configuration around the copper ring 110 with the ring at the bend of the U and the fibres forming the limbs of the U extending down the tube. This provides a permanent wick, that is, a wick which is not consumed during operation of the burner and in which liquid fuel is drawn up between the filaments as combustion proceeds.

Burner 36 also includes a burner plate 122 which in this embodiment takes the form of a disc having a diameter slightly larger than the diameter of the top of shroud 104. In the assembled burner, disc 122 is disposed at a spacing above the wick as best seen in FIG. 2. During combustion, primary combustion air flows up through tube 88 while secondary combustion air flows between the tubes 114 and to the exterior of the wick as best shown in FIG. 3, providing secondary air. Disc 122 directs the primary and secondary combustion air outwardly and has been found to provide a stabilized flame and avoid smokey tails. As such, disc 122 may not been essential to operation of the burner although it is preferred for the reasons indicated. A pair of crossed plates 124 and 126 at the underside of disc 122 extend down into tube 88 when the burner is assembled to support the disc and assist in directing the primary combustion air outwardly in a controlled manner. Disc 122 is also located by a pair of wire conductors generally indicated at 128 and 130 respectively. Each conductor includes a pair of vertical limbs which extend downwardly into the fuel reservoir and which are connected at their upper ends by a cross member. In FIG. 3, the two cross members are indicated respectively at 132 and 134 and the vertical limbs at 136 and 138. At their lower ends, the vertical limbs are turned outwardly as indicated at **136*a* and 138*a* respectively. These outwardly turned portions of the limbs rest on the bottom of the fuel reservoir as shown in FIG. 2. The cross members 132 and 134 are curved to conform with the curvature of disc 122 and the two supports are designed to frictionally grip the periphery of the disc 122** and hold it in position by friction only. This allows the disc to be readily removed, for example, to provide access to the wick. This may be necessary in order to prime the wick with wax if the burner has been allowed to burn dry.

Conductors 128 and 130 transfer heat from the combustion zone 48 down into the fuel reservoir. For speed of heat conduction, the conductors are preferably made of copper wire or rod. This function of conducting heat to the fuel reservoir is of particular importance in this embodiment because the heater is designed to use paraffin wax fuel, for the reasons discussed above. Since the wax is normally solid at room temperatures, the solid wax within the fuel reservoir must be melted relatively quickly. As soon as combustion is established in the combustion zone, some of the heat of combustion will be conducted by the conductors 128 and 130 into the fuel reservoir to begin melting the wax. In practice, it has been found that start-up can be achieved relatively easily by simply placing a lighted match in the combustion zone 48. It has been found that there will be sufficient residual wax in the wick, which will ignite almost immediately to establish combustion. The heat of combustion will be rapidly conducted down to the fuel reservoir to melt the main body of fuel.

Referring back to FIGS. 1 and 2, it will be remembered that the fuel reservoir is designed as a drawer which can be removed from housing in the direction of arrow 44 in FIG. 1. FIG. 1 also shows the top structure 90 of the fuel reservoir, the remainder of which is in effect formed by an open-topped steel box across the top of which top 90 is welded. Top 90 is slightly shorter than the back-to-front depth of the box, leaving a space at the front which is provided with a spring-closed door 140 through which blocks of paraffin wax can be inserted into the fuel reservoir. In FIG. 2, the door is shown in ghost outline as having been deflected downwardly for receiving a block of paraffin wax. This arrangement allows the heater to be refueled in operation by simply raising the door 24 at the front of the housing 20 and inserting one or more blocks of wax downwardly into the fuel reservoir through door 140.

In FIG. 1, the main housing door 24 is shown partially raised as it would be for refueling. A lip 24*a* at the bottom of the door is provided with a wire handle 142 to allow the door to be raised without the user being burnt, even when the heater is in operation. FIG. 1 also illustrates the fact that, by raising the door to the position shown, the fuel reservoir and burner assembly can be withdrawn from housing 20 as a unit. Not only does this permit easy servicing but the burner/fuel reservoir assembly can then be used separately, for example to provide heat for cooking or as a warning flare.

It will of course be understood that the preceding description relates to a particular preferred embodiment of the invention only and that many modifications of the invention are possible. For example, the burner/fuel reservoir assembly could be made and sold separately for either or both of the uses indicated above. Also, the burner need not necessarily operate using paraffin wax as a fuel. That type of fuel does offer significant advantages which are discussed above but, in principle, the burner could be used with other fuels including fuels which are liquid at room temperatures. Also, the burner itself need not be of the exact form shown. In some cases, the burner plate 122 could be omitted as indicated previously. Also, the main air supply tube 88 need not be circular, nor need the support 110 for the wick filaments. Thus, the term "annular" as used in the claims which follow should be interpreted broadly as simply denoting an element defining a closed loop, but not necessarily a circular loop.

The aspect of the invention relating to a heater as a whole need not be limited to the particular type of burner disclosed. Broadly, other forms of burner are possible and it might even be feasible to use one or more paraffin wax candles as the burner although difficulties probably would be encountered in achieving sufficient heat output from a candle burner. Several candles would probably be needed, possibly as many as five. Also, candles tend to burn with a smokey flame.

The burner wick may take various forms. A wick made of glass, asbestos or other fibres has been specifically described above. Wicks formed from other materials capable of withstanding combustion temperatures and providing the required capilliary action may also be used successfully, e.g. porous ceramic materials, glass fibre cloths or tapes. Specifically, a wick made of several glass fibre tapes looped over the annular support (110) of the burner side-by-side have been used; multiple layers of tape or cloth will normally be required.

I claim:

1. A heater comprising:

a housing defining a combustion chamber and adapted to permit radiation of heat produced by combustion in said chamber, the combustion chamber having an exhaust outlet, and the housing including a combustion air inlet passageway;

a fuel reservoir disposed in said housing below the combustion chamber, for containing a fuel supply;

a burner disposed in the combustion chamber and comprising: a combustion air inlet tube disposed in a generally upright position above said fuel reservoir and having an air outlet at its upper end and an air inlet at its lower end, said air inlet communicating with said combustion air inlet passageway; a wick in the form of a mass of non-combustible fibres wrapped around an annular support surrounding said air outlet and defining a combustion zone; means constraining the fibres to extend downwardly from said support and into the fuel reservoir for conveying liquid fuel to said combustion zone; and means for delivering secondary combustion air to said combustion zone externally of the wick, from said combustion air inlet passageway; said means constraining the fibres of the burner comprising a series of tubes extending downwardly from positions adjacent said air outlet of the combustion air inlet tube and into the fuel reservoir, said fibres being disposed in said tubes, the tubes being coupled together adjacent said inlet tube to provide a substantially continuous annular wick and being spaced from one another away from said tube to permit said secondary combustion air to flow outwardly between the tubes;

and, a vent duct defining a first passageway providing communication between said air inlet passageway in the housing and a remote air inlet at an outer end of the duct, and a second passageway providing communication between said combustion chamber exhaust outlet and an exhaust opening adjacent said air inlet, said duct being of elongate form and extending outwardly from said housing to space said air inlet and exhaust outlet from the housing so as to permit the heater to be disposed within a space to be heated and vented outside said space by way of said vent.

2. A heater as claimed in claim 1, wherein said duct is inclined upwardly from said housing and wherein portions of said first and second passageways of the duct adjacent the outer end of the duct are directed generally vertically in opposite directions to define said exhaust opening and air inlet respectively as considered with said housing generally vertically disposed.

3. A heater as claimed in claim 1, wherein said first duct passageway surrounds said second duct passageway over substantially the entire length of the duct, whereby the exterior surface of the duct is insulated from the heat of combustion products in said second passageway by air in said first passageway.

4. A heater as claimed in claim 1, wherein said housing includes a heating chamber which is accessible from externally of the housing and which is adapted to receive articles to be heated, said heating chamber being positioned above said combustion chamber and arranged to be heated by the heat of combustion.

5. A heater as claimed in claim 1, wherein said housing includes a door in a front wall of the housing adapted to be opened to provide access to said combustion chamber.

6. A heater as claimed in claim 1, wherein said housing is provided with a handle movable between a position for carrying the heater and a position in which the handle can be used to support the heater relative to an adjacent surface defining an enclosure to be heated, said handle and housing being provided with co-operable means adapted to adjustably position the handle with respect to the housing at this time.

7. A heater as claimed in claim 1, wherein said burner is supported on said fuel reservoir and the burner and reservoir are designed to be removable as a unit from the housing.

8. A heater as claimed in claim 1, wherein said burner further comprises a burner plate supported in a position above and spaced from said air outlet of the combustion air inlet tube for deflecting outwardly air leaving said outlet and said secondary combustion air, said plate defining the upper extent of said combustion zone.

9. A heater as claimed in claim 8, wherein said plate is supported by heat conductive elements which extend downwardly into said fuel reservoir for conducting heat from said combustion zone into said reservoir, whereby the burner is adapted to operate using fuel which is solid at room temperature.

10. A heater as claimed in claim 1, wherein said fuel reservoir includes a top structure defining an air duct communicating with said air inlet passageway and with said combustion air inlet tube, said tubes constraining the fibres of the wick extending through said duct, and wherein the burner further includes a shroud surrounding said tubes and spaced outwardly therefrom, said shroud communicating with said duct for providing secondary combustion air to said combustion zone.

11. A heater as claimed in claim 1, wherein said non-combustible fibres are glass fibres.

12. A heater as claimed in claim 1, wherein said annular support is a ring of copper wire.

13. A heater as claimed in claim 1, wherein said mass of non-combustible fibres comprises fibrous cloth or tape.

14. In a heater including a housing defining a combustion chamber and adapted to permit radiation of heat produced by combustion in said chamber, a fuel reservoir disposed in the housing below the combustion chamber for containing a fuel supply, a burner disposed in the combustion chamber and including a wick communicating with the fuel supply, an exhaust outlet from said combustion chamber, and combustion air supply means communicating with said burner;

the improvement wherein said burner comprises a combustion air inlet tube disposed in a generally upright position above said fuel reservoir and having an air outlet at its upper end and an air inlet at its lower end, said inlet communicating with said combustion air inlet of the heater; said wick comprising a mass of non-combustible fibres wrapped around an endless support surrounding said air outlet and defining a combustion zone; means constraining the fibres to extend downwardly from said support and into the fuel reservoir for conveying liquid fuel to said combustion zone; and means for delivering secondary combustion air to said combustion zone externally of the wick, from said combustion air inlet passageway; said means constraining the fibres of the burner comprising a series of tubes extending downwardly from positions adjacent said air outlet of the combustion air inlet tube and into the fuel reservoir, said fibres being disposed in said tubes, the tubes being coupled together adjacent said inlet tube to provide a substantially continuous annular wick and being spaced from one another away from said tube to permit said secondary combustion air to flow outwardly between the tubes.

* * * * *